US008303805B2

(12) United States Patent
Hatanaka et al.

(10) Patent No.: US 8,303,805 B2
(45) Date of Patent: Nov. 6, 2012

(54) PROCESS FOR PRODUCING GASOLINE BASE AND GASOLINE

(75) Inventors: Shigeto Hatanaka, Yokohama (JP); Koji Shimada, Yokohama (JP); Hideshi Iki, Yokohama (JP)

(73) Assignee: Nippon Oil Corporation, Tokyo (JP)

( * ) Notice: Subject to any disclaimer, the term of this patent is extended or adjusted under 35 U.S.C. 154(b) by 183 days.

(21) Appl. No.: 12/681,787

(22) PCT Filed: Oct. 6, 2008

(86) PCT No.: PCT/JP2008/068162

§ 371 (c)(1),
(2), (4) Date: May 18, 2010

(87) PCT Pub. No.: WO2009/048041

PCT Pub. Date: Apr. 16, 2009

(65) Prior Publication Data

US 2010/0219102 A1 Sep. 2, 2010

(30) Foreign Application Priority Data

Oct. 12, 2007 (JP) ..... P2007-267031

(51) Int. Cl.
*C10G 45/06* (2006.01)
*C10G 45/08* (2006.01)
*C10G 65/02* (2006.01)

(52) U.S. Cl. ..... 208/210; 208/59; 208/60; 208/216 R; 208/217

(58) Field of Classification Search ..... 208/59, 208/60, 210, 216 R, 217
See application file for complete search history.

(56) References Cited

U.S. PATENT DOCUMENTS

| | | | |
|---|---|---|---|
| 4,149,965 A | 4/1979 | Pine et al. | |
| 4,990,242 A | 2/1991 | Louie et al. | |
| 5,352,354 A | 10/1994 | Fletcher et al. | |
| 5,906,730 A | 5/1999 | Hatanaka et al. | |
| 6,231,753 B1 | 5/2001 | McKnight et al. | |
| 2003/0217951 A1 | 11/2003 | Marchal-George et al. | |
| 2004/0026298 A1 | 2/2004 | Ellis et al. | |
| 2005/0023192 A1 * | 2/2005 | Iki et al. | 208/216 R |

FOREIGN PATENT DOCUMENTS

| | | |
|---|---|---|
| JP | 9-040972 | 2/1997 |
| JP | 2000-505358 | 5/2000 |
| JP | 2000-239668 | 9/2000 |
| JP | 2003-528942 | 9/2003 |
| JP | 2003-327970 | 11/2003 |
| JP | 2005-034736 | 2/2005 |
| JP | 2006-508196 | 3/2006 |
| WO | 97/40120 | 10/1997 |

OTHER PUBLICATIONS

International Search Report that issued with respect to PCT/JP2008/068162, mailed Jan. 20, 2009.
Naoto Miyoshi et al., "Development of NOx Storage-Reduction Catalyst," Toyota Technical review, vol. 50, No. 2, pp. 28-33, Dec. 2000.
Thomas R. Halbert et al., "Technology Options For Meeting Low Sulfur Mogas Targets," NPRA Annual Meeting, AM-00-11, pp. 1-15, Mar. 26, 2000.
International Preliminary Report on Patentability, including the Written Opinion (in English) for PCT/JP2008/068162, mailed May 20, 2010.
Office Action issued with respect to patent family member Japanese Patent Application No. 2007-267031, mailed Jul. 17, 2012.

* cited by examiner

*Primary Examiner* — Randy Boyer
(74) *Attorney, Agent, or Firm* — Greenblum and Bernstein P.L.C.

(57) ABSTRACT

The production process of the invention comprises a first step of hydrodesulfurizing of catalytically-cracked gasoline so as to result in an olefin hydrogenation rate of no greater than 25 mol % in the catalytically-cracked gasoline, a total sulfur content of no greater than 20 ppm by weight based on the product oil weight, a sulfur content derived from thiophenes and benzothiophenes of no greater than 5 ppm by weight and a sulfur content derived from thiacyclopentanes of no greater than 0.1 ppm by weight, and a second step of further hydrodesulfurizing of the product oil obtained by the first step so as to result in a total of no greater than 30 mol % for the olefin hydrogenation rate in the first step and the olefin hydrogenation rate in the second step, a total sulfur content of no greater than 10 ppm by weight based on the product oil weight, and a sulfur content derived from thiols of no greater than 5 ppm by weight.

6 Claims, No Drawings

PROCESS FOR PRODUCING GASOLINE BASE AND GASOLINE

TECHNICAL FIELD

The present invention relates to a process for producing a gasoline base, and to gasoline.

BACKGROUND ART

Catalytically-cracked gasoline contains 20-40 vol % olefins and is therefore an important gasoline blendstock with a high octane value and a high blending ratio into finished gasoline. Catalytically-cracked gasoline is produced by catalytic cracking of heavy petroleums such as vacuum gas oil or atmospheric residue with a fluidized catalytic cracker (FCC). The sulfur content of these heavy petroleums undergoes various reactions in the production process, becoming lighter oils, and therefore sulfur compounds are present in the catalytically-cracked gasoline. In order to minimize the sulfur content of catalytically-cracked gasoline, it is common for the feed oil such as vacuum gas oil or atmospheric residue to be used in catalytic cracking after hydrodesulfurization. Heavy oil hydrodesulfurizers are high temperature-high pressure apparatuses, and the start-up costs, expansions and upgrades for such equipment needed to meet tighter restrictions on sulfur content, in line with environmental policy, lead to increased cost for both installation and operation, thus increasing the economic burden.

On the other hand, since the sulfur compounds in catalytically-cracked gasoline can be hydrodesulfurized with relatively low temperature and low pressure apparatuses, direct hydrodesulfurization of catalytically-cracked gasoline not only lowers cost for equipment investment but can also reduce operating costs compared to hydrodesulfurization of heavy oil. Nevertheless, the prior art, that is, hydrodesulfurization of catalytically-cracked gasoline in hydrodesulfurizers for naphtha, has been problematic due to hydrogenation of olefins in the catalytically-cracked gasoline which reduces the octane value. Several technologies have been proposed to solve this problem, whereby hydrodesulfurization is accomplished while limiting reduction in the octane value of catalytically-cracked gasoline. For example, there have been proposed a technique involving separation of feed oil into light and heavy components by distillation and separate hydrodesulfurization of the components under separate conditions (see Patent document 1, for example), a method of using a catalyst with controlled molybdenum and cobalt loading weights and support surface areas (see Patent document 2, for example), a method of combination with a zeolite catalyst to prevent reduction in octane value (see Patent document 3, for example), and a method using a catalyst subjected to specific pretreatment (see Patent document 4, for example). Among processes for producing gasoline with low sulfur contents there has been proposed a process for producing gasoline that includes a step of hydrogenation of the unsaturated sulfur-containing compounds and a step of decomposition of the saturated sulfur-containing compounds (see Patent document 5, for example). Such processes, however, are suitable for treatment of catalytically-cracked gasoline with high sulfur content but not for production of gasoline with very low sulfur content.

The need for "sulfur-free gasoline" with even lower sulfur content has recently been proposed. Lean burn engines and direct injection engines have high energy efficiency and are considered to contribute to reduced carbon dioxide emission. However, because such engines carry out combustion in a high air-fuel ratio range, NOx generation is increased and conventional exhaust gas purification catalysts do not function effectively. It has therefore been attempted to apply NOx storage catalysts as exhaust gas purification catalysts for engines, and according to Toyota Technical Review Vol. 50, No 2, p. 28-33 (December 2000), a finished gasoline sulfur content of no greater than 8 ppm by weight is within the permissible range for catalyst inactivation, suggesting potential application of NOx storage catalysts. The aforementioned conventional gasoline hydrodesulfurization technologies give consistent indications regarding hydrodesulfurization of catalytically-cracked gasoline, but it has not been possible to reach a level that can provide finished gasoline with an extremely low sulfur content of no greater than 8 ppm by weight. Non-patent document 1, identified below, tangentially refers to results of hydrodesulfurization to a sulfur content of 8 ppm by weight, but decrease of the road octane value (the average of the research octane value and motor octane value) is 3.8 compared to before hydrodesulfurization treatment, and therefore the technique cannot be considered practical.

In order to achieve a sulfur content of no greater than 8 ppm by weight for finished gasoline it is necessary to reduce the sulfur content of the catalytically-cracked gasoline, as its compositional base, to no greater than about 10 ppm by weight, and development of such production techniques is expected to be a key technology for production and provision of sulfur-free gasoline.

[Patent document 1] U.S. Pat. No. 4,990,242
[Patent document 2] Japanese Patent Public Inspection No. 2000-505358
[Patent document 3] U.S. Pat. No. 5,352,354
[Patent document 4] U.S. Pat. No. 4,149,965
[Patent document 5] Japanese Unexamined Patent Publication No. 2000-239668
[Non-patent document 1] NPRA Annual Meeting, AM-00-11 (2000)

DISCLOSURE OF THE INVENTION

Problems to be Solved by the Invention

It is an object of the present invention to provide a process for producing a gasoline base with a sulfur content of no greater than 10 ppm by weight, by which catalytically-cracked gasoline can be hydrodesulfurized with reduction in the octane value limited to a suitably practical level, to obtain sulfur-free gasoline base, as well as gasoline comprising the obtained gasoline base. The reduction in octane value with hydrodesulfurization is preferably a research octane value reduction of no greater than about 1, based on the catalytically-cracked gasoline before hydrodesulfurization treatment. If the reduction range is no greater than about 1, it will be possible to compensate for the increased octane value resulting from increased operating temperature of a reformer used to produce reformed gasoline used as a separate gasoline base.

Means for Solving the Problems

In order to solve the problems described above, the present inventors conducted much diligent research on the structures of sulfur compounds in catalytically-cracked gasoline feed, the mechanisms of hydrodesulfurization reaction and the suitability of hydrodesulfurization catalysts therefore, and the invention has been completed as a result of this research.

Specifically, the invention provides the process comprising:

a first step of hydrodesulfurizing of catalytically-cracked gasoline so as to result in an olefin hydrogenation rate of no greater than 25 mol % in the catalytically-cracked gasoline, a total sulfur content of no greater than 20 ppm by weight based on the product oil weight, a sulfur content derived from thiophenes and benzothiophenes of no greater than 5 ppm by weight and a sulfur content derived from thiacyclopentanes of no greater than 0.1 ppm by weight, and a second step of further hydrodesulfurizing of the product oil obtained by the first step so as to result in a total of no greater than 30 mol % for the olefin hydrogenation rate in the first step and the olefin hydrogenation rate in the second step, a total sulfur content of no greater than 10 ppm by weight based on the product oil weight, and a sulfur content derived from thiols of no greater than 5 ppm by weight.

The term "catalytically-cracked gasoline" according to the invention means the gasoline fraction produced by cracking of heavy petroleums with an FCC, and refers to FCC gasoline with a boiling point range of about 30-210° C.

Component analyses were by the following methods. The total sulfur content was measured by coulometric titration, the sulfur contents derived from sulfur compounds were measured using a GC-SCD (Sulfur Chemiluminescence Detector), and qualitative analysis of the sulfur compounds and hydrocarbon components of the product oils was carried out by GC-MS.

The catalysts used in the first step and second step of the invention are preferably catalysts comprising one or more metals selected from among cobalt, molybdenum, nickel and tungsten, respectively.

The catalyst used in the first step is preferably a catalyst obtained by loading one or more metals selected from among cobalt, molybdenum, nickel and tungsten on a support comprising a metal oxide composed mainly of alumina and containing at least one metal component selected from the group consisting of alumina-modifying alkali metals, iron, chromium, cobalt, nickel, copper, zinc, yttrium, scandium and lanthanoid metals.

The reaction conditions for the first step are preferably a reaction temperature of 200-270° C., a reaction pressure of 1-3 MPa, an LHSV of 2-7 $h^{-1}$ and a hydrogen/oil ratio of 100-600 NL/L, and the reaction conditions for the second step are preferably a reaction temperature of 300-350° C., a reaction pressure of 1-3 MPa, an LHSV of 10-30 $h^{-1}$ and a hydrogen/oil ratio of 100-600 NL/L.

The catalytically-cracked gasoline supplied for the first step is a heavy fraction from which the light fraction has been separated by distillation, with a boiling point range of 80-210° C., and a total sulfur content of no greater than 200 ppm by weight based on the catalytically-cracked gasoline weight.

The catalyst used in the second step is preferably a catalyst comprising nickel supported on a support.

The invention further provides a gasoline comprising a gasoline base obtained by the production process of the invention.

Effect of the Invention

According to the invention it is possible to efficiently produce a gasoline base with minimal octane value reduction and a low sulfur content of no greater than 10 ppm by weight, and the obtained gasoline base can be used as a base for sulfur-free gasoline. The production process of the invention is revolutionary in that it allows production of a gasoline base with an extremely low sulfur content of no greater than 10 ppm by weight, which has not been achievable in the prior art.

BEST MODE FOR CARRYING OUT THE INVENTION

There are no particular restrictions on the catalytically-cracked gasoline used as feed for the process for producing a gasoline base according to the invention, but normally it will have a boiling point range of about 30-210° C. Because the sulfur content is not very high in the light fraction obtained by fractional distillation of catalytically-cracked gasoline, it is effective to separate the light fraction by fractional distillation and hydrodesulfurize only the heavy fraction which has a high sulfur content. In this case, the boiling point range of the heavy fraction is most optimally in the range of 80-210° C.

Although the sulfur content of the catalytically-cracked gasoline that is used is not restricted, it may be no greater than 1000 ppm by weight, preferably no greater than 700 ppm by weight, even more preferably no greater than 500 ppm and most preferably no greater than 200 ppm by weight based on the catalytically-cracked gasoline weight, in order to inhibit the reduction in octane value due to hydrogenation of olefins that occurs during hydrodesulfurization, while also facilitating production of a gasoline base with a sulfur content of no greater than 10 ppm by weight. When the heavy fraction of catalytically-cracked gasoline is used as feed, the sulfur content is also preferably in the range specified above.

In the first step of the production process of the invention, the olefin hydrogenation rate in the catalytically-cracked gasoline is no greater than 25 mol % and preferably no greater than 20 mol %. An olefin hydrogenation rate of greater than 25 mol % will increase reduction in the octane value of the product oil obtained by the second step, which is undesirable for a gasoline base. The olefin hydrogenation rate is calculated from the olefin content in the catalytically-cracked gasoline feed and product oil, as analyzed and quantified by gas chromatography and GC-MS, and it is defined by the following formula.

$$\text{Olefin hydrogenation rate}(\%)=100\times(1-(\text{moles of olefins in product oil}/\text{moles of olefins in feed}))$$

In the first step of the production process of the invention, the total sulfur content is no greater than 20 ppm by weight, the sulfur content derived from thiophenes and benzothiophenes is no greater than 5 ppm by weight and the sulfur content derived from thiacyclopentanes (including benzothiacyclopentanes) is 0.1 ppm by weight, in the product oil, based on the product oil weight. If these sulfur contents exceed the specified upper limits, it will be difficult to lower the total sulfur content in the product oil obtained from the second step to no greater than 10 ppm by weight. Thiacyclopentanes and benzothiacyclopentanes are reconverted to thiophenes and benzothiophenes in the second step of the production process of the invention thus impeding hydrodesulfurization, while production of thiols also lowers the desulfurization rate. The sulfur content derived from thiols in the product oil of the first step is preferably no greater than 20 ppm by weight.

The olefin hydrogenation rate in the second step of the production process of the invention satisfies the condition that the total of the olefin hydrogenation rate in the first step and the olefin hydrogenation rate in the second step is no greater than 30 mol % and preferably no greater than 25 mol %. A total hydrogenation rate of greater than 30 mol % will increase reduction in the octane value of the obtained product oil, which is undesirable for a gasoline base.

The total sulfur content in the product oil of the second step of the production process of the invention, based on the product oil weight, is no greater than 10 ppm by weight. The sulfur content derived from thiols in the product oil of the second step is no greater than 5 ppm by weight and preferably no greater than 3 ppm by weight.

The catalysts used in the first step and second step of the production process of the invention may be catalysts comprising one or more metals selected from among cobalt, molybdenum, nickel and tungsten. These metals generally exhibit activity as sulfides when loaded onto supports such as porous alumina. Alternatively, they may be reduced catalysts prepared by coprecipitation from metal salts.

The same catalyst may be used in the first step and second step of the production process of the invention, but preferably different catalysts are used for greater performance in each step. The catalyst used in the first step is preferably a catalyst with low hydrogenation activity for olefins and thiophenes. Minimizing olefin hydrogenation is associated with maintaining octane value. Patent document 5 employs a catalyst with high hydrogenation activity for unsaturated sulfur-containing compounds in step a, but although this method is suitable for treatment of catalytically-cracked gasoline with high sulfur content, it is not suitable as a method for production of a gasoline base with a sulfur content of no greater than 10 ppm by weight from catalytically-cracked gasoline feed with a relatively low sulfur content.

In first step of the invention, thiols are by-products from the olefins in the catalytically-cracked gasoline and the hydrogen sulfide generated by hydrodesulfurization. It is preferred to use a catalyst which has low activity for these by-product reactions and can achieve the sulfur content derived from by-product thiols of no greater than 20 ppm by weight based on the weight of the product oil of the first step.

The catalyst satisfying these conditions that is used in the first step of the invention is preferably a catalyst obtained by loading one or more metals selected from among cobalt, molybdenum, nickel and tungsten on a support comprising a metal oxide composed mainly of alumina and containing at least one metal component selected from the group consisting of alumina-modifying alkali metals, iron, chromium, cobalt, nickel, copper, zinc, yttrium, scandium and lanthanoid metals. The metal oxide modifying the support composed mainly of alumina is more preferably a metal oxide containing at least one metal component selected from the group consisting of potassium, copper, zinc, yttrium, lanthanum, cerium, neodymium, samarium and ytterbium. Modification of the support composed mainly of alumina with these metal oxides is preferably accomplished by a method of mixing these metal oxides or their precursors with an alumina precursor, and calcining the mixture.

The catalyst used for the second step of the invention is also preferably a catalyst with low hydrogenation activity for olefins. A catalyst with high hydrodesulfurization activity for by-product thiols from the first step is also preferred. As specific catalysts there may be used cobalt/molybdenum catalysts with low activity or nickel catalysts produced by precipitation methods. Particularly preferred are catalysts having nickel supported on a support such as alumina.

The reaction conditions in the first step of the production process of the invention are preferably a reaction temperature of 200-270° C., a reaction pressure of 1-3 MPa, an LHSV of 2-7 $h^{-1}$ and a hydrogen/oil ratio of 100-600 NL/L. If reaction is conducted in the first step at as low a reaction temperature as possible and with a low LHSV, it will be possible to obtain a high desulfurization rate while inhibiting hydrogenation of olefins. If the reaction is conducted at too low a temperature, however, attention must be given to accelerated reaction that produces thiols from olefins and the hydrogen sulfide generated by hydrodesulfurization.

The reaction conditions in the second step of the production process of the invention are preferably a reaction temperature of 300-350° C., a reaction pressure of 1-3 MPa, an LHSV of 10-30 $h^{-1}$ and a hydrogen/oil ratio of 100-600 NL/L. Since a high reaction temperature in the second step will promote hydrocracking of thiol by-products from the first step, high temperature/high LHSV is preferred, but the optimum conditions may be set in consideration of the catalyst life. It is particularly important to set the LHSV, and care must be taken that it is not less than 10 $h^{-1}$ to avoid promoting hydrogenation of olefins.

Thiols will be present in the catalytically-cracked gasoline obtained from the first step and second step of the production process of the invention, in an amount of several ppm by weight. These thiols can be converted to disulfides by sweetening, to obtain negative doctor test results. The sweetening process used may be a known process, such as the Merox process. In this process, thiols are converted to disulfides by oxidation reaction in the presence of an iron group chelate catalyst such as cobalt phthalocyanine. If the sulfur content derived from thiols can be reduced to no greater than 3 ppm by weight, the doctor test results will be negative, thus allowing use as a finished gasoline base without sweetening.

The catalytically-cracked gasoline treated by the method described above can be blended with other bases such as reformed gasoline (reformates) to produce sulfur-free finished gasoline. There are no particular restrictions on the blending, but preferably the blending ratio is adjusted based on the properties of each base, so that finished gasoline standards are met. Finished gasoline containing a gasoline base produced by the production process of the invention will easily have a sulfur content of no greater than 8 ppm by weight and an octane value in a range suitable for practical use.

EXAMPLES

The present invention will now be explained in greater detail based on examples, comparative examples and reference examples, with the understanding that these examples are in no way limitative on the invention.

Reference Example 1

<Production of Catalyst>

After adding 0.29 g of potassium hydroxide to 200 g of commercially available alumina sol (solid content: 10 wt %) and thoroughly stirring the mixture, the moisture was evaporated off and the residue was extrusion molded into a 1/32-inch columnar shape. It was then dried at 100° C. and calcined at 500° C. for 2 hours to prepare an alumina support containing 1 wt % potassium. An aqueous solution containing 1.75 g of cobalt nitrate hexahydrate and 2.09 g of ammonium molybdate tetrahydrate was impregnated into 7.85 g of the support by a common method and dried at 100° C., and then calcined at 500° C. for 4 hours to obtain a potassium oxide-modified alumina-supported cobalt/molybdenum catalyst. As a result of analysis, the composition of the catalyst was $MoO_3$: 17.0 wt %, CoO: 4.5 wt %, $Al_2O_3$: 77.5 wt %, $K_2O$: 1.0 wt %, based on the weight of the catalyst, with a surface area of 258 $m^2/g$ and a pore volume of 0.45 ml/g. This catalyst will hereunder be referred to as "catalyst A".

<Model Reaction>

A feed for a catalytically-cracked gasoline model was used to confirm the effectiveness of the invention. Thiophene was dissolved in a mixture of 80 vol % toluene and 20 vol % diisobutylene to a sulfur content of 100 ppm by weight based on the weight of the mixture. The thiophene represented a sulfur compound in catalytically-cracked gasoline, and the diisobutylene represented an olefin in catalytically-cracked gasoline.

Two fixed bed reactors were used, packing the first reactor with catalyst A and the second reactor with a supported nickel-based catalyst HTC-200 (trade name) by Crosfield, and these were linked in series to a tube. For use of the catalysts, they were subjected to sulfidizing treatment and then to coking treatment to further reduce the hydrogenation activity. The model feed and hydrogen gas were continuously supplied through the side of the first reactor, for hydrodesulfurization reaction. The product oils from the first reactor and second reactor were sampled, the total sulfur content was measured by coulometric titration, the sulfur content derived from sulfur compounds were measured using a GC-SCD (Sulfur Chemiluminescence Detector), and qualitative analysis of the sulfur compounds and hydrocarbon components of the product oils was carried out by GC-MS. The reaction conditions in the first reactor and second reactor are shown in Table 1 and the product oil analysis results are shown in Table 2. The sulfur content derived from sulfur compounds and total sulfur content are based on each product oil, and the desulfurization rate is defined as follows.

Desulfurization rate(%)=100×(1−total sulfur content of product oil)/total sulfur content of feed oil

TABLE 1

| | First reactor | Second reactor |
|---|---|---|
| Catalyst | Catalyst A | Ni-based catalyst (HTC-200) |
| Temperature (° C.) | 200 | 300 |
| Pressure (MPa) | 2.0 | 2.0 |
| LHSV ($h^{-1}$) | 7 | 20 |
| Hydrogen/oil ratio (NL/L) | 338 | 338 |

TABLE 2

| Sulfur content, desulfurization rate, olefin hydrogenation rate | Product oil of first reactor | Product oil of second reactor |
|---|---|---|
| Sulfur content derived from thiophenes (ppm by wt.) | 4 | 3 |
| Sulfur content derived from thiacyclopentanes (ppm by wt.) | 0 | 0 |
| Sulfur content derived from butylthiols (ppm by wt.) | 0 | 0 |
| Sulfur content derived from octylthiols (ppm by wt.) | 15 | 5 |
| Total sulfur content (ppm by wt.) | 19 | 8 |
| Desulfurization rate (%) | 81 | 92 |
| Olefin (diisobutylene) hydrogenation rate (mol %) | 22 | 28 |

Thiophene hydrodesulfurization proceeds in the first reactor. Because a catalyst with low hydrogenation activity was used, no thiacyclopentane or butylthiol production was found in the thiophene hydrogenation product. Octylthiol was also produced by reaction between diisobutylene and hydrogen sulfide generated by the hydrodesulfurization. In the second reactor, the octylthiol produced by the first reactor was hydrodesulfurized, yielding a model gasoline base with a total sulfur content of no greater than 10 ppm by weight.

Example 1

Hydrodesulfurization reaction was conducted under the same conditions and with the same procedure as Reference Example 1, except that heavy catalytically-cracked gasoline (15° C. density: 0.793 g/cm$^3$, boiling point: initial boiling point 79° C. to end point 205° C., research octane value: 90.3, olefin content: 32 vol %, sulfur content: 121 ppm by weight) was used as the feed oil and the reaction temperature in the first reactor was 250° C. The results are shown in Table 3.

TABLE 3

| Sulfur content, desulfurization rate, olefin hydrogenation rate, octane value | Product oil of first reactor | Product oil of second reactor |
|---|---|---|
| Thiophenes and benzothiophenes (ppm by wt.) | 4 | 3 |
| Thiacyclopentane sulfur content (ppm by wt.) | 0 | 0 |
| Thiol sulfur content (ppm by wt.) | 14 | 3 |
| Total sulfur content (ppm by wt.) | 18 | 6 |
| Desulfurization rate (%) | 85 | 95 |
| Olefin hydrogenation rate (mol %) | 13 | 15 |
| Research octane value | 88.9 | 88.7 |

Comparative Example 1

Hydrodesulfurization of heavy catalytically-cracked gasoline was conducted under the same conditions and with the same procedure as Example 1, except that first reactor alone was used and the reaction temperature was 265° C. The results are shown in Table 4.

TABLE 4

| Sulfur content, desulfurization rate, olefin hydrogenation rate, octane value | Product oil of first reactor |
|---|---|
| Thiophenes and benzothiophenes (ppm by wt.) | 2 |
| Thiacyclopentane sulfur content (ppm by wt.) | 0 |
| Thiol sulfur content (ppm by wt.) | 13 |
| Total sulfur content (ppm by wt.) | 15 |
| Desulfurization rate (%) | 88 |
| Olefin hydrogenation rate (mol %) | 31 |
| Research octane value | 87.5 |

Comparative Example 2

Hydrodesulfurization of heavy catalytically-cracked gasoline was conducted under the same conditions and with the same procedure as Example 1, except that the catalyst in the first reactor was the commercially available catalyst HR306C (trade name) by Procatalyse as a common hydrodesulfurization catalyst, the reaction temperature was 250° C., and the LHSV in the second reactor was 2. The reaction conditions are shown in Table 5, and the results are shown in Table 6.

TABLE 5

| | Product oil of first reactor | Product oil of second reactor |
|---|---|---|
| Catalyst | Hydrodesulfurization catalyst (HR360C) | Ni-based catalyst (HTC-200) |
| Temperature (° C.) | 250 | 300 |
| Pressure (MPa) | 2.0 | 2.0 |
| LHSV ($h^{-1}$) | 7 | 2 |
| Hydrogen/oil ratio (NL/L) | 338 | 338 |

TABLE 6

| Sulfur content, desulfurization rate, olefin hydrogenation rate, octane value | Product oil of first reactor | Product oil of second reactor |
|---|---|---|
| Thiophenes and benzothiophenes (ppm by wt.) | 8 | 6 |
| Thiacyclopentane sulfur content (ppm by wt.) | 0 | 0 |
| Thiol sulfur content (ppm by wt.) | 33 | 8 |
| Total sulfur content (ppm by wt.) | 41 | 14 |
| Desulfurization rate (%) | 66 | 88 |
| Olefin hydrogenation rate (mol %) | 23 | 30 |
| Research octane value | 87.8 | 87.1 |

In Example 1, a gasoline base was obtained with a sulfur content of no greater than 10 ppm by weight and minimal reduction in octane value due to olefin hydrogenation. This was attributed to the use of a catalyst with low olefin hydrogenation activity in the first reactor, and reaction conditions in the second reactor which drastically inhibited olefin hydrogenation while allowing the thiol sulfur content to be reduced.

With hydrodesulfurization in a single step as in Comparative Example 1, the octane value reduction due to olefin hydrogenation was significant, making it difficult to produce a gasoline base with a practical level of reduction and a sulfur content of no greater than 10 ppm by weight.

In Comparative Example 2, the catalyst used in the first reactor had high olefin hydrogenation activity compared to catalyst A, and therefore the octane value reduction in the first reactor was significant. The catalyst also had low desulfurization activity and a low desulfurization rate in the first reactor. The reaction conditions in the second reactor also differed from Example 1, and the octane value reduction in the same reactor was significant. In other words, this method produced a large reduction in the octane value, while it was also difficult to produce a gasoline base with a sulfur content of no greater than 10 ppm by weight.

The invention claimed is:

1. A process for producing a gasoline base, the process comprising:

a first step of hydrodesulfurizing of catalytically-cracked gasoline so as to result in an olefin hydrogenation rate of no greater than 25 mol % in the catalytically-cracked gasoline, a total sulfur content of no greater than 20 ppm by weight based on the product oil weight, a sulfur content derived from thiophenes and benzothiophenes of no greater than 5 ppm by weight and a sulfur content derived from thiacyclopentanes of no greater than 0.1 ppm by weight, and a second step of further hydrodesulfurizing of the product oil obtained by the first step so as to result in a total of no greater than 30 mol % for the olefin hydrogenation rate in the first step and the olefin hydrogenation rate in the second step, a total sulfur content of no greater than 10 ppm by weight based on the product oil weight, and a sulfur content derived from thiols of no greater than 5 ppm by weight.

2. The process for producing a gasoline base according to claim 1, wherein the catalysts used in the first step and second step of the invention are catalysts comprising one or more metals selected from among cobalt, molybdenum, nickel and tungsten, respectively.

3. The process for producing a gasoline base according to claim 1, wherein the catalyst used in the first step is a catalyst obtained by loading one or more metals selected from among cobalt, molybdenum, nickel and tungsten on a support comprising a metal oxide composed mainly of alumina and containing at least one metal component selected from the group consisting of alumina-modifying alkali metals, iron, chromium, cobalt, nickel, copper, zinc, yttrium, scandium and lanthanoid metals.

4. The process for producing a gasoline base according to claim 1, wherein the reaction conditions in the first step are a reaction temperature of 200-270° C., a reaction pressure of 1-3 MPa, an LHSV of 2-7 $h^{-1}$ and a hydrogen/oil ratio of 100-600 NL/L, and the reaction conditions in the second step are a reaction temperature of 300-350° C., a reaction pressure of 1-3 MPa, an LHSV of 10-30 $h^{-1}$ and a hydrogen/oil ratio of 100-600 NL/L.

5. The process for producing a gasoline base according to claim 1, wherein the catalytically-cracked gasoline supplied for the first step is a heavy fraction from which the light fraction has been separated by distillation, with a boiling point range of 80-210° C., and a total sulfur content of no greater than 200 ppm by weight based on the catalytically-cracked gasoline weight.

6. The process for producing a gasoline base according to claim 1, wherein the catalyst used in the second step is a catalyst comprising nickel supported on a support.

* * * * *